US012050091B2

(12) United States Patent
Chase et al.

(10) Patent No.: US 12,050,091 B2
(45) Date of Patent: Jul. 30, 2024

(54) AXIAL RESET TARGET

(71) Applicant: ORIGIN Tactical Solutions LLC, Windsor, CO (US)

(72) Inventors: Matthew J. Chase, Windsor, CO (US); Graham Powers, Windsor, CO (US)

(73) Assignee: ORIGIN TACTICAL SOLUTIONS LLC, Windsor, CO (US)

( * ) Notice: Subject to any disclaimer, the term of this patent is extended or adjusted under 35 U.S.C. 154(b) by 24 days.

(21) Appl. No.: 17/658,235

(22) Filed: Apr. 6, 2022

(65) Prior Publication Data

US 2023/0324151 A1 Oct. 12, 2023

(51) Int. Cl.
*F41J 7/04* (2006.01)

(52) U.S. Cl.
CPC ..... *F41J 7/04* (2013.01)

(58) Field of Classification Search
CPC ..... F41J 7/04
See application file for complete search history.

(56) References Cited

U.S. PATENT DOCUMENTS 2,113,719 A * 4/1938 Creswell ..... F41J 7/04 273/386
2,957,694 A * 10/1960 Barber ..... F41J 5/18 273/390
6,994,348 B2 * 2/2006 Lambert ..... F41J 7/04 273/392
7,690,656 B2 * 4/2010 Saunders ..... F41J 3/0004 273/392
8,807,570 B1 * 8/2014 Zalar ..... F41J 7/04 273/390
9,446,301 B2 * 9/2016 Leimberer ..... A63F 9/0204
D792,551 S * 7/2017 Zalar ..... D22/113
10,119,795 B2 * 11/2018 Daub ..... F41J 7/04
(Continued)

FOREIGN PATENT DOCUMENTS

EP 506671 B1 * 5/1996 ..... E05F 15/53
SE 467755 B * 9/1992 ..... F41J 7/06

OTHER PUBLICATIONS

Robert Zalar, "Sophia Target Shooting," https://www.youtube.com/watch?v=hBOQ2KMtsFU, uploaded Nov. 4, 2015 (Year: 2015).*
(Continued)

*Primary Examiner* — Laura Davison
(74) *Attorney, Agent, or Firm* — Trenner Law Firm, LLC; Mark Trenner

(57) ABSTRACT

An axial reset target structure is disclosed for supporting targets during target practice. An example axial reset target structure includes a base member with a base ramp. The example axial reset target structure also includes a target mounting member for mounting a target thereto. The example axial reset target structure also includes a mounting ramp in the target mounting member. The example axial reset target structure has at least one firing position for firing at the target mounted to the target mounting member. The example axial reset target structure also has a hit position when the target is struck. The mounting ramp rotates in a first direction relative to the base ramp to move the target mounting member away from the base member in the hit position. The target automatically resets to the at least one firing position.

20 Claims, 14 Drawing Sheets

(56) References Cited

U.S. PATENT DOCUMENTS

| | | | | |
|---|---|---|---|---|
| 10,533,829 | B2 * | 1/2020 | Holmberg | F41J 7/04 |
| 2011/0233868 | A1 * | 9/2011 | Massier | F41J 7/04<br>273/368 |

OTHER PUBLICATIONS

English machine translation of Pilskaer (SE-467755-B) (Year: 1992).*

* cited by examiner

AXIAL RESET TARGET

BACKGROUND

Target practice is an important aspect of firearm training for law enforcement and other individuals. At indoor target ranges, paper targets are typically hung by a hanger on a wire that can be moved out any desired distance from the shooter. Unfortunately, indoor target ranges can be expensive, crowded, noisy, and are not available in all areas.

Often, those desiring target practice head outdoors. Target shooting is permitted on a lot of federal land and on private property. In addition to overcoming the shortfalls of indoor target ranges, outdoor ranges allow shooters to be outdoors, often with more space around them, at little or no cost.

At outdoor target ranges, targets are often tacked to cardboard boxes, fallen trees, strung between trees or other objects in the field, etc. These targets are often unstable and may fall over during target practice and need to be set up again several times during the course of target practice.

Professional targets are available, but often have to be manually reset. The primary drawback is having to walk down the firing range to reset the target after it has been hit. Not only is this time consuming, but can also be dangerous if other shooters are present.

DETAILED DESCRIPTION

Figure 1:
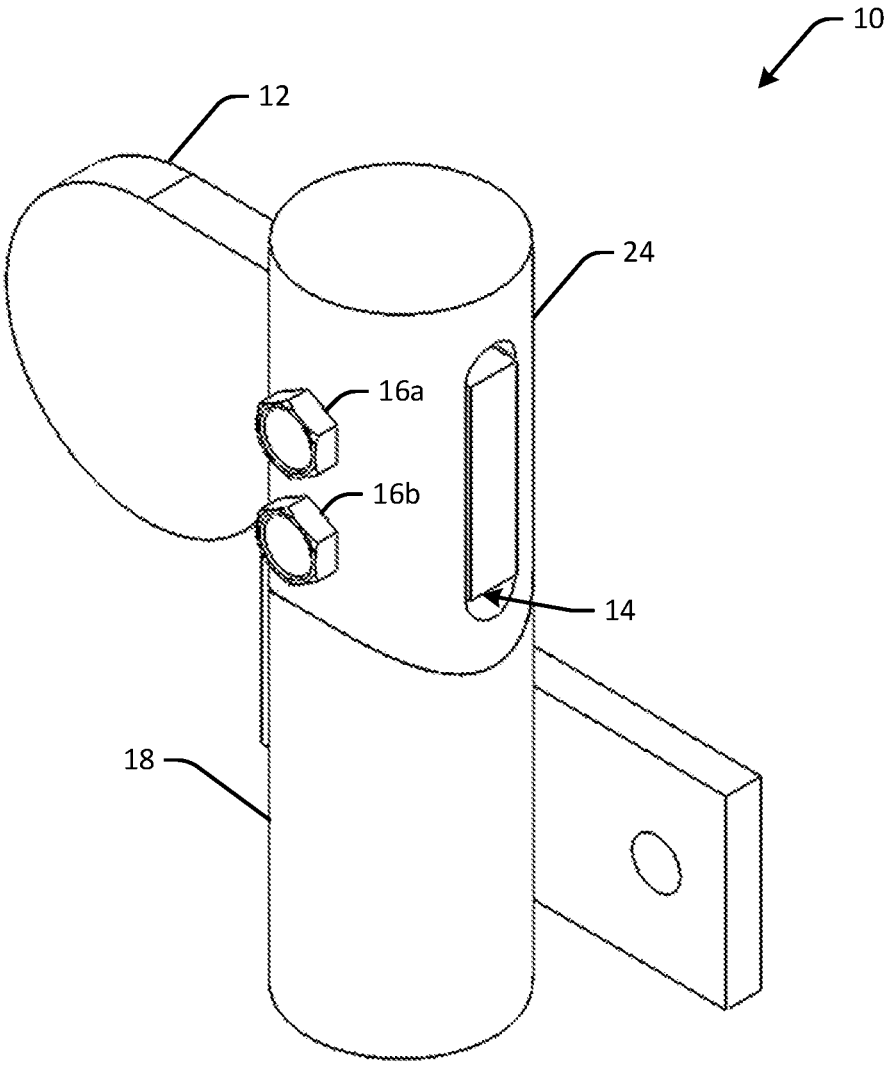
FIG. 1 is a top perspective view of an example axial reset target structure, shown in a first firing position.

An axial reset target structure is disclosed for supporting targets during target practice. An example axial reset target structure includes a base member with a base ramp. The example axial reset target structure also includes a target mounting member for mounting a target thereto. The example axial reset target structure also includes a mounting ramp in the target mounting member. The example axial reset target structure has at least one firing position for firing at the target mounted to the target mounting member. The example axial reset target structure also has a hit position when the target is struck. The mounting ramp rotates in a first direction relative to the base ramp to move the target mounting member away from the base member in the hit position. The target automatically resets to the firing position. The example axial reset target structure is readily assembled for use in a variety of different operational configurations with a variety of different types of targets.

The axial reset target is a target system designed to allow for dynamic multi-target systems and automatically resetting targets without the need for the shooter to manually reset targets. The system uses a single helical ramp, or a group of integrated helical ramps, which causes horizontal movement of the target into vertical motion. This vertical motion is resisted axially. Examples include, but are not limited to resistance by gravity or a device such as a magnet, tension spring, or compression spring, air bags, pistons, compressible and resilient foam and/or rubber, or a weighted configuration. This force is applied axially through the axis of rotation and does not need to be angled in order to function.

When in motion, the motion of the target is resisted by the force through the helical ramp, and upon its first impact with a stopping point, the remaining kinetic energy is insufficient to climb the ramp again against this resistance. The force then pulls the target into a final resting position at the bottom of the ramp, resetting the target without the need for intervention from the shooter.

This mechanism and the target itself can be separated, allowing for the replacement of targets due to wear or in order to change function. Additionally, different slotting allows targets to be placed in the mechanism at angles from 0 to 30 degrees, in order to allow for safe operation by deflecting projectiles down towards the ground.

The example axial reset target structure can be implemented for use with horizontal shooting targets and vertical shooting targets. The example axial reset target structure enables a user to change various types and sizes of targets quickly and easily in the field.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

FIG. 1 is a top perspective view of an example axial reset target structure, shown in a first firing position. An axial reset target structure 10 is disclosed for supporting targets 12 during target practice. It is noted that the paddle 12 shown in the FIG. 1 may be the actual target and/or a support or mount for a target attached thereto. Any size and/or shape and/or type (e.g., metal or other material of manufacture) may be implemented with the axial reset target structure 10.

In an example, the target 12 may be removably inserted into the axial reset target structure 10 to be interchangeable with other targets or target mounts. For example, the target 12 is illustrated in FIG. 1 secured in chamber 14 of the axial reset target structure 10 by securements 16*a*, 16*b* in openings 17*a*, 17*b* (see, e.g., FIGS. 6 and 7). Any suitable securements 16*a*, 16*b* may be provided. Examples of securements 16*a*, 16*b* include but are not limited to one or more screws, thumb screws, pins, etc. This enables the end-user to change target and/or target mounting types. In another example, the target 12 may be formed integral with, or as part of (e.g. so that it is not interchangeable), at least a portion of the axial reset target structure 10.

Figure 2:
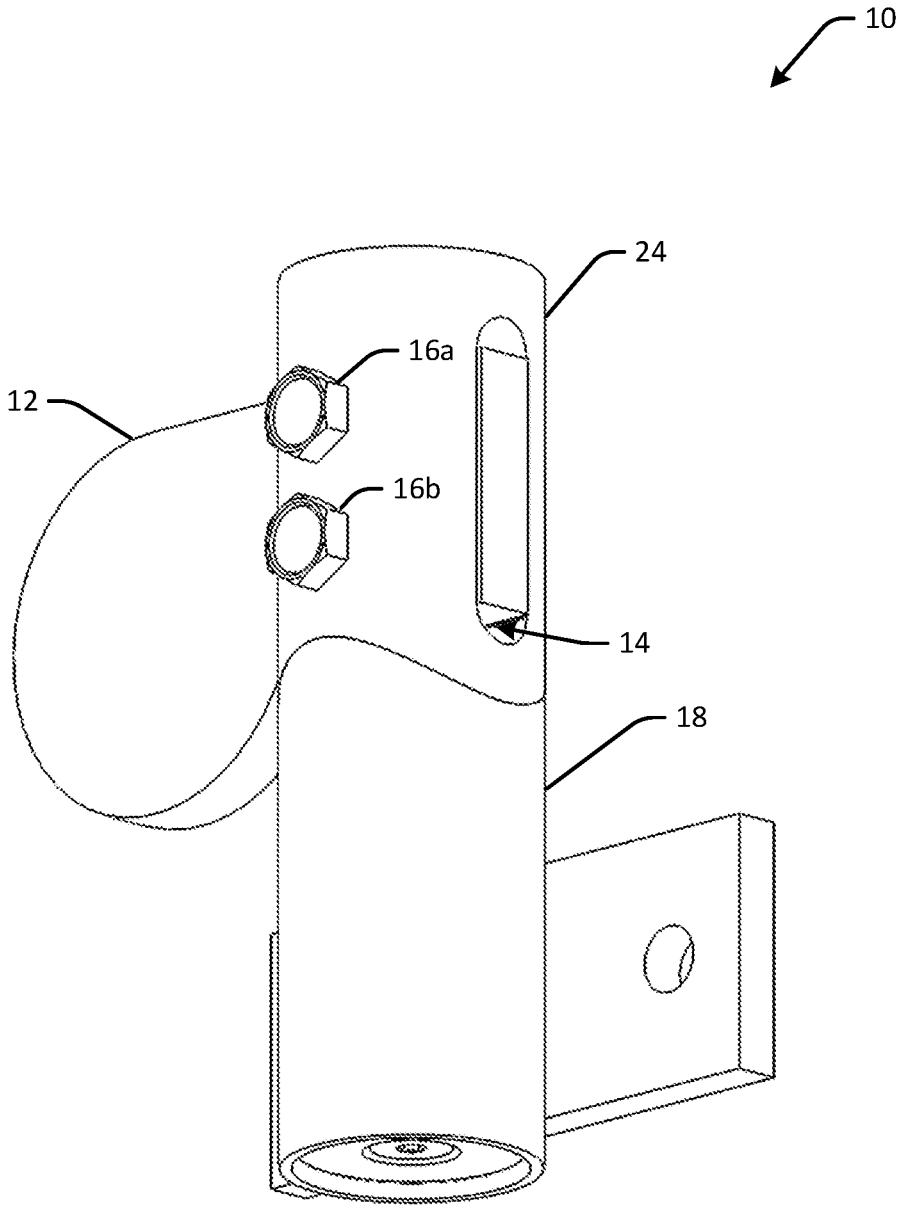
FIG. 2 is a bottom perspective view of an example axial reset target structure, shown in a first firing position.
Figure 3:
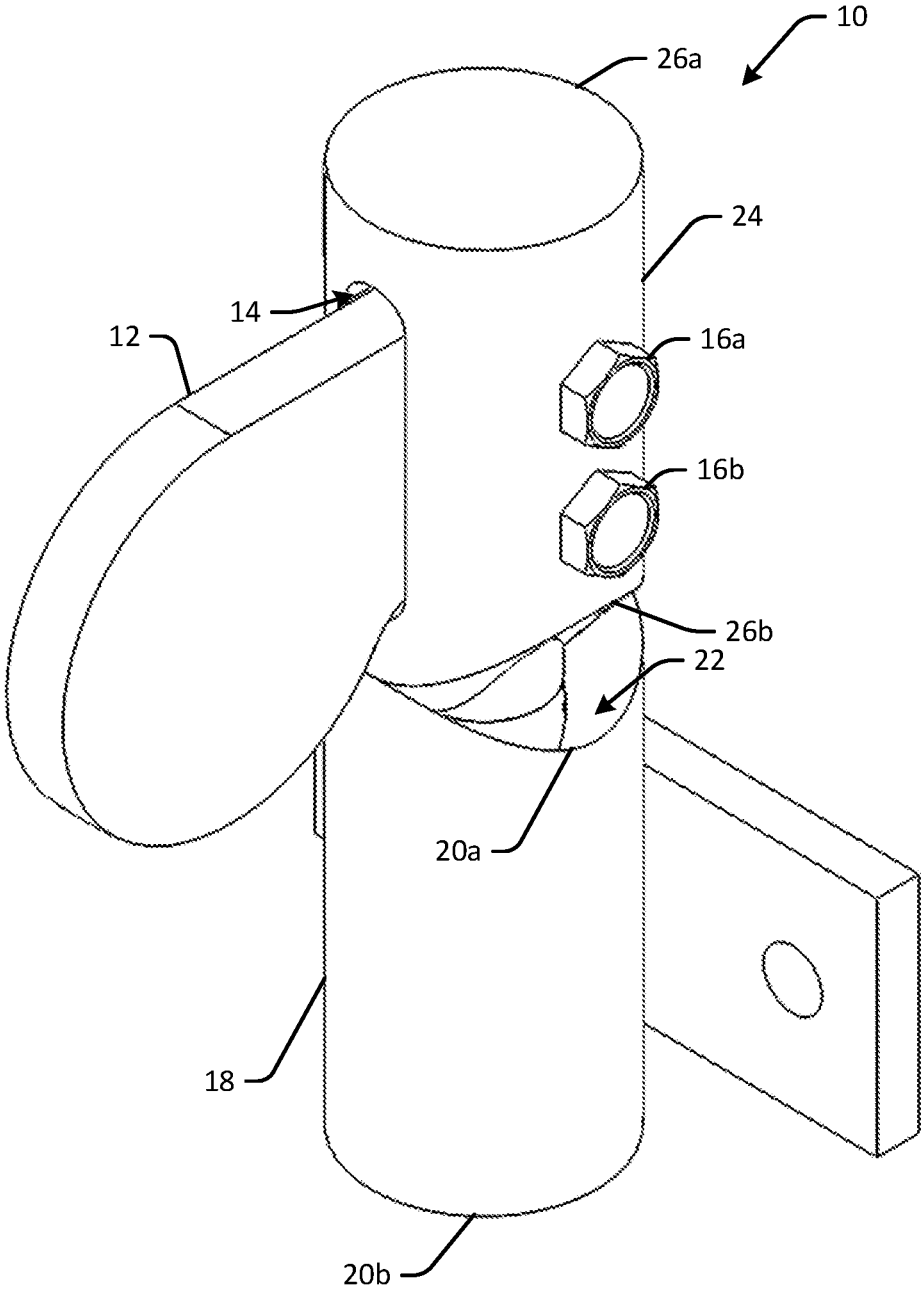
FIG. 3 is a perspective view of the example axial reset target structure of FIG. 1, shown in a hit position.
Figure 4:
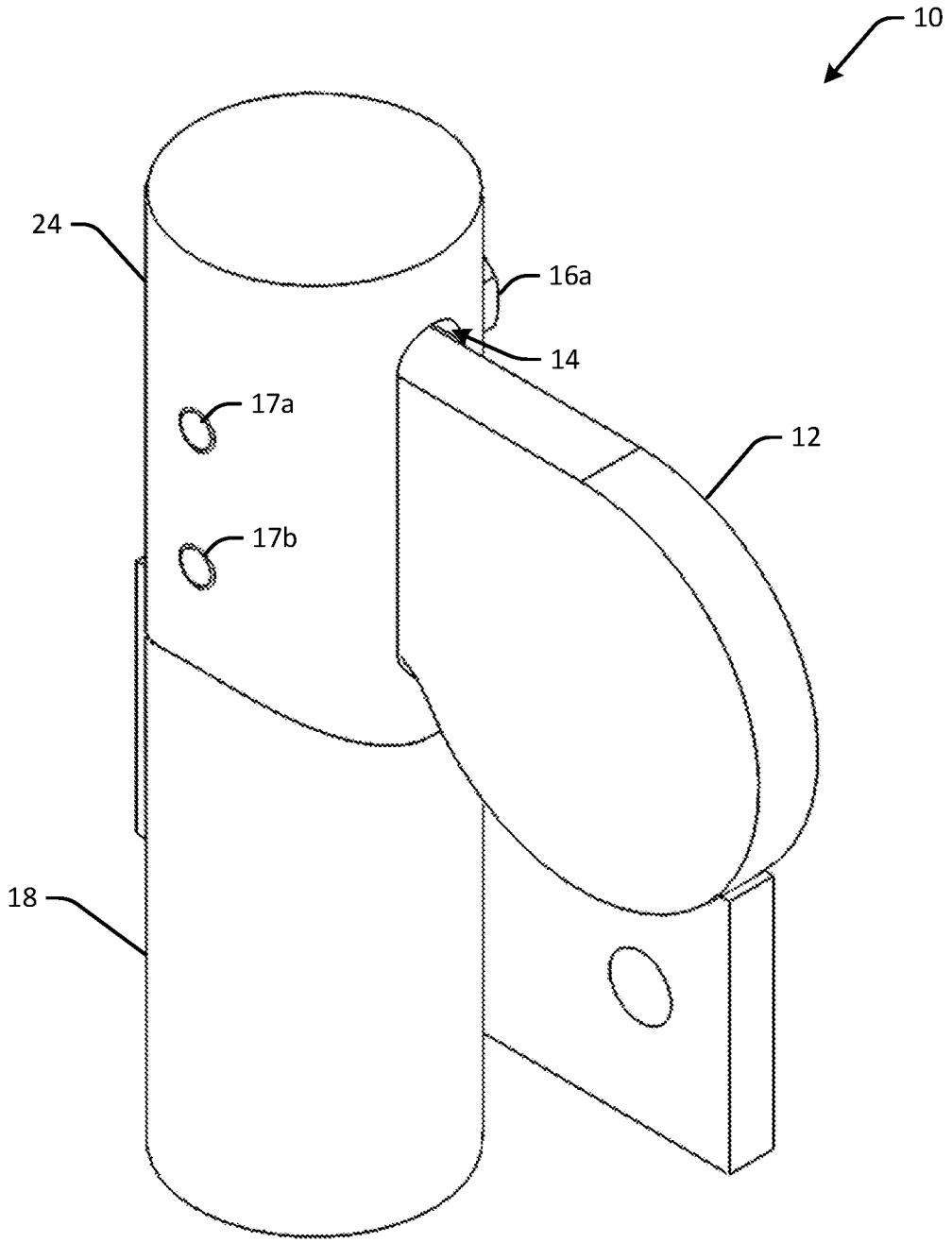
FIG. 4 is a front perspective view of an example axial reset target structure, shown in a second firing position.

FIG. 2 is a bottom perspective view of the example axial reset target structure 10. The example axial reset target structure 10 is shown in FIGS. 1 and 2 to illustrate a first firing position. FIG. 3 is a perspective view of the example axial reset target structure 10 of FIG. 1. The example axial reset target structure 10 is shown in FIG. 3 to illustrate a hit position. FIG. 4 is a front perspective view of an example axial reset target structure 10. The example axial reset target structure 10 is shown in FIG. 4 to illustrate a second firing position. See also, FIG. 5 discussed below for further illustrations of firing and hit positions.

The example axial reset target structure 10 includes a base member 18 having an upper portion 20*a* and a lower portion 20*b*. A base ramp 22 is provided in the upper portion 20*a* of the base member 18. The base ramp 22 has a first mating surface (e.g., the top or outside surface). The example axial reset target structure 10 also includes a target mounting member 24 having an upper portion 26*a* and a lower portion 26*b*. The target mounting member 24 is for mounting a target 12 thereto, as discussed above with reference to FIG. 1. A mounting ramp 28 (see, e.g., FIGS. 6 and 7) is provided in the lower portion 20*b* of the target mounting member 24. The mounting ramp 28 has a second mating surface (e.g., the bottom or outside surface).

Figure 5:
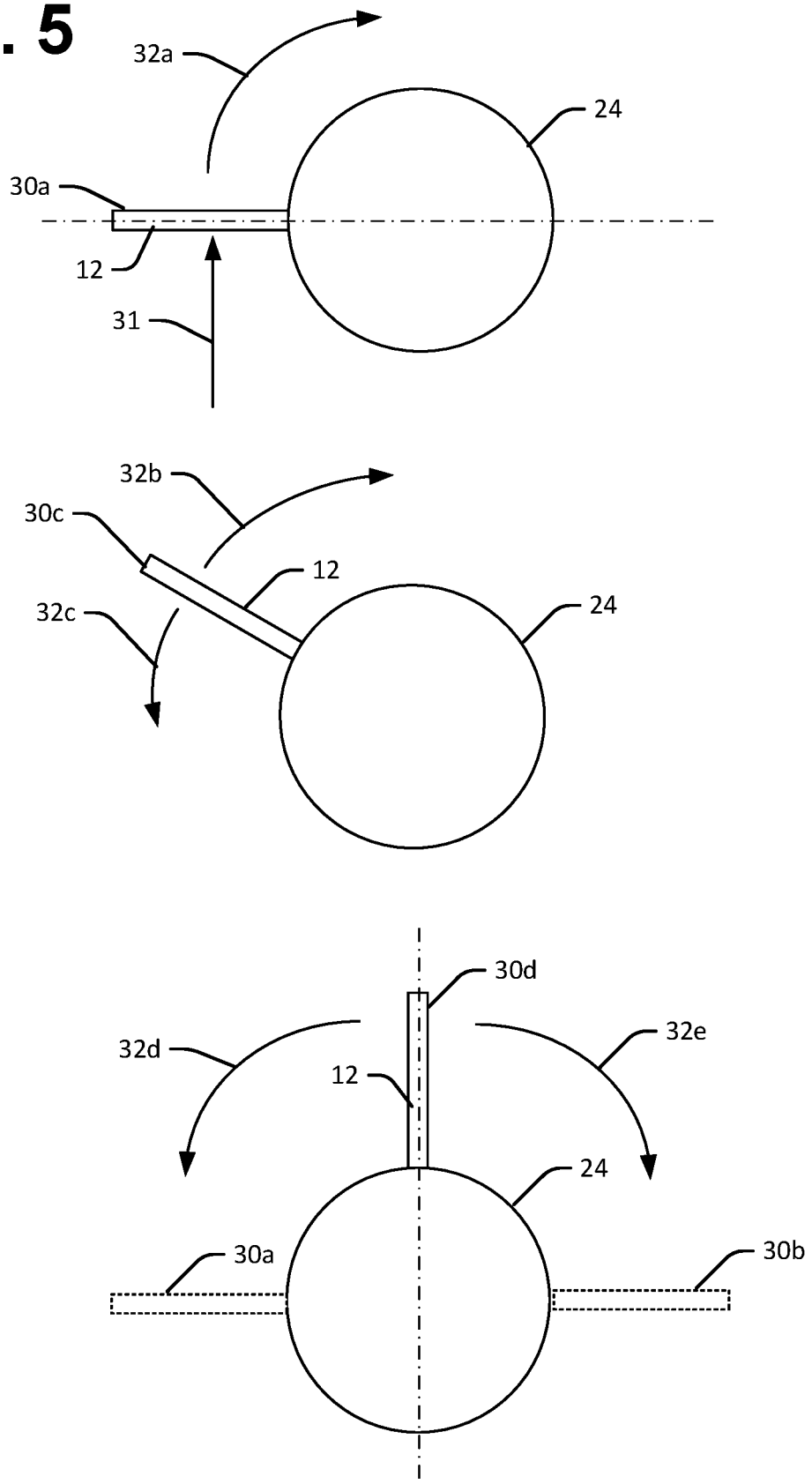
FIG. 5 is a top view illustration of example operating positions of the axial reset target structure.

FIG. 5 is a top view illustration of example operating positions of the axial reset target structure 10. In an example, at least one firing position is provided for firing at the target 12 mounted to the target mounting member 24. In FIG. 5, two firing positions 30*a*, 30*b* are illustrated (e.g., viewed by the shooter on the right side 30*a*, and left side 30*b*, of the example axial reset target structure 10). In the firing position (s) 30*a*, 30*b*, the first mating surface of the base ramp 22 mates with the second mating surface of the mounting ramp 24.

A hit position 30*c*, 30*d* is provided for when the target 12 is struck by a projectile (e.g., in the direction illustrated by arrow 31). The hit position 30*c* may be defined as any position behind the firing position(s) 30*a*, 30*b* (e.g., just less than 180 degrees between 30*a* and 30*b*). The hit position may be referred to herein as a full hit position 30*d*, when the target 12 is perpendicular to the firing position(s) 30*a*, 30*b*. In the hit position 30*c*, 30*d*, the mounting ramp 28 rotates in a first direction (e.g., illustrated by arrow 32*a* or 32*b*) relative to the base ramp 22 to move the target mounting member 24 away from the base member 18 (e.g., in an upward or vertical direction) as the target mounting member 24 "climbs" the base ramp 22. It is noted that if the target 12 is in firing position 30*b*, that the first direction is opposite that illustrated by arrow 32*a*.

The target 12 may be reset to either firing position 30*a*, 30*b*. For example, the target 12 may be manually reset by the user. In an example, the target automatically resets to at least one of the firing positions 30*a*, 30*b*. Automatic reset is discussed in more detail below with reference to FIG. 10. In either case (manual or automatic reset), the mounting ramp 28 rotates in a second direction (e.g., illustrated by arrows 32*c*, 32*d*, and 32*e*) relative to the base ramp 22 to return the target mounting member 24 back to one of the firing positions 30*a*, 30*b*, thereby resetting the target 12 for firing.

The terms "first" and "second" as these are used herein to refer to direction are not intended to be limiting, and are only used to distinguish between different directions. In an example, the first direction is opposite the second direction. For example, the first direction may be clockwise and the second direction is then counterclockwise. Or for example, the first direction is counterclockwise and the second direction is clockwise.

Figure 6:
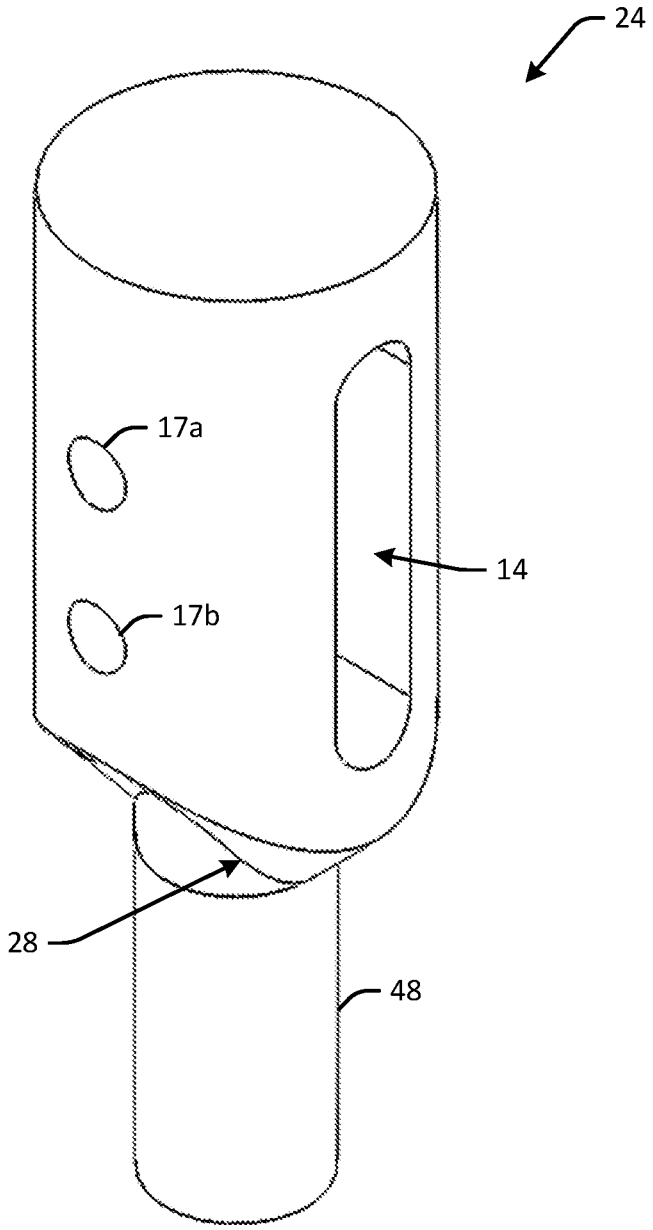
FIG. 6 is a top perspective view of an example target mounting member of the axial reset target structure.
Figure 7:
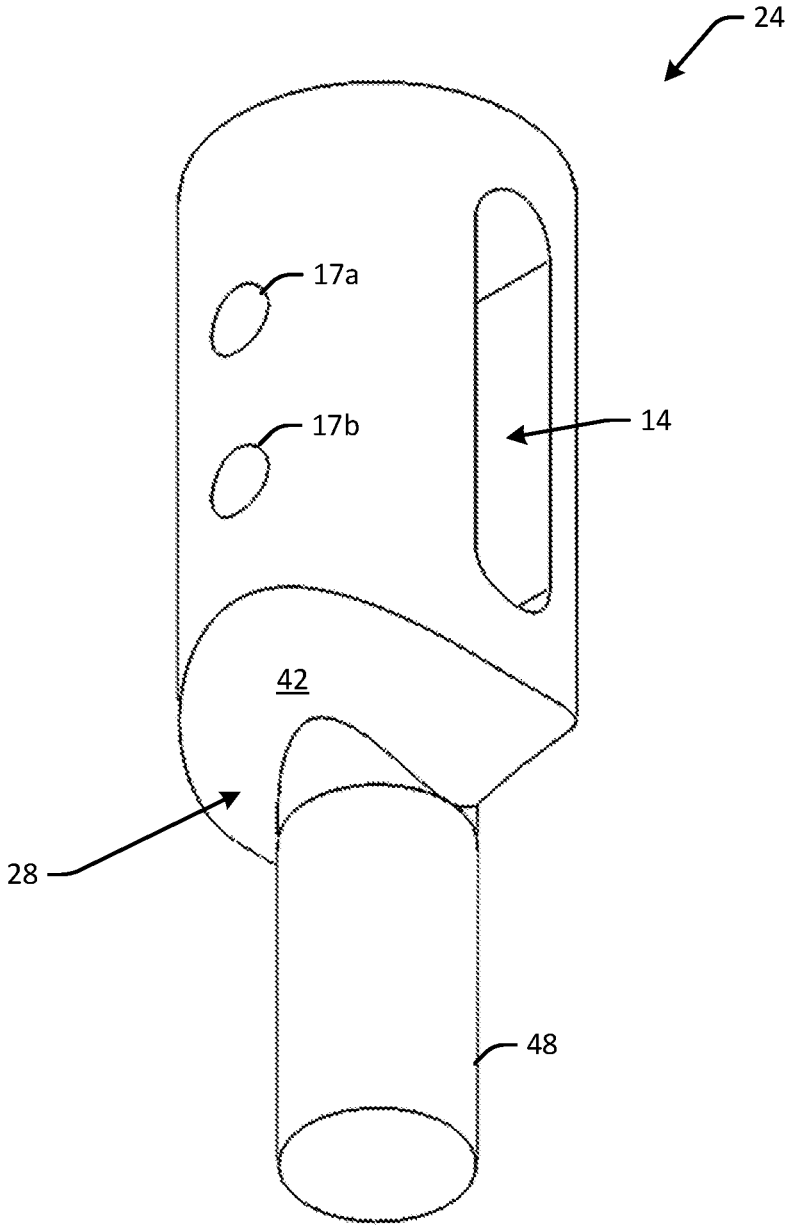
FIG. 7 is a bottom perspective view of an example target mounting member of the axial reset target structure.
Figure 8:
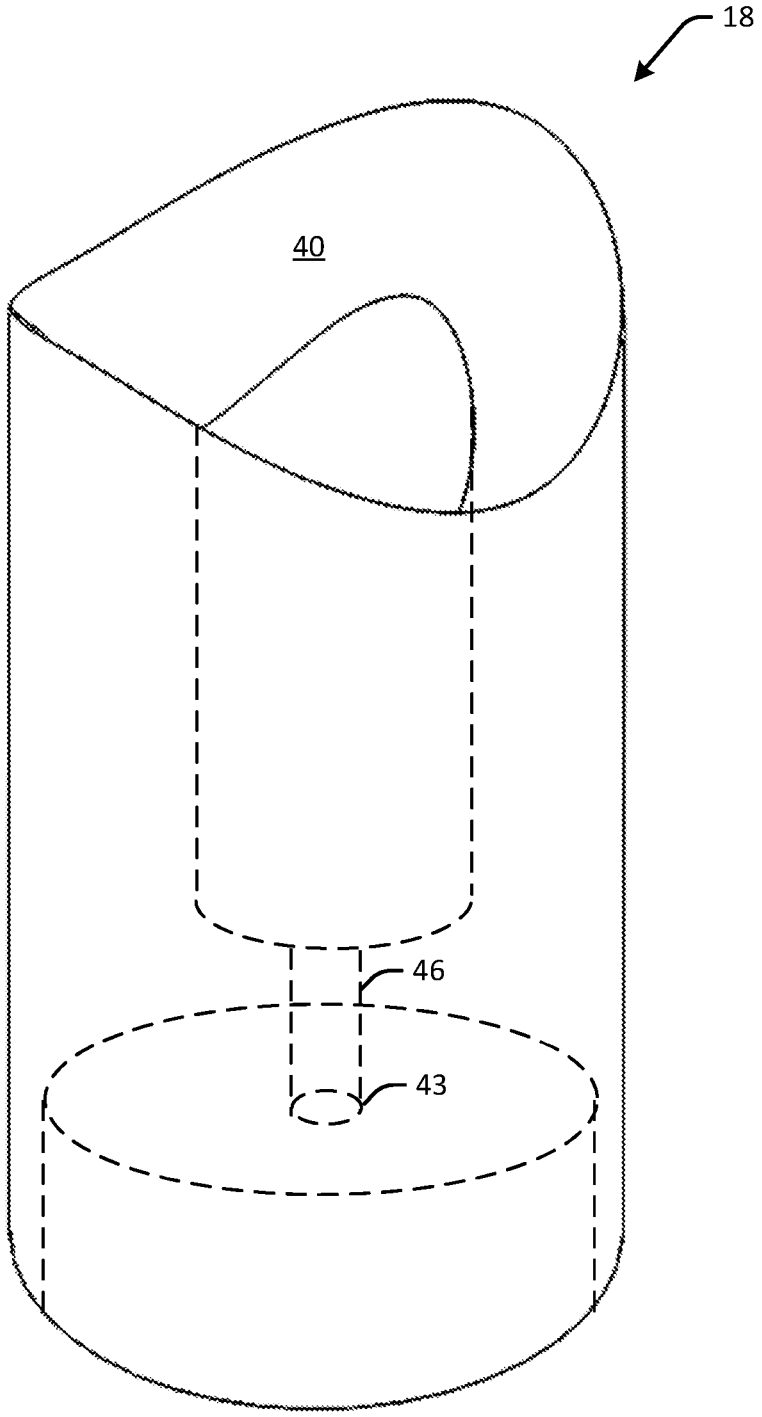
FIG. 8 is a top perspective view of an example base member of the axial reset target structure.
Figure 9:
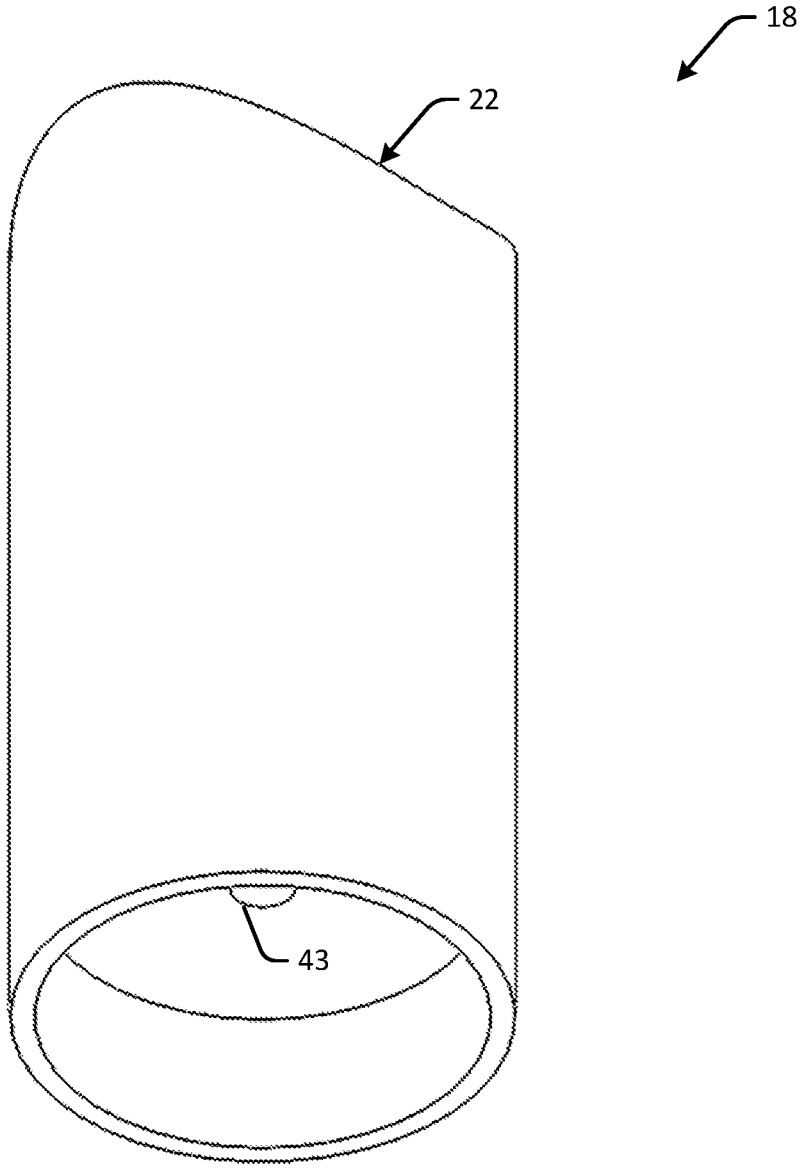
FIG. 9 is a bottom perspective view of an example base member of the axial reset target structure.

FIG. 6 is a top perspective view of an example target mounting member 24 of the axial reset target structure 10. FIG. 7 is a bottom perspective view of the example target mounting member 24 of the axial reset target structure 10. FIG. 8 is a top perspective view of an example base member 18 of the axial reset target structure 10. FIG. 9 is a bottom perspective view of the example base member 18 of the axial reset target structure 10.

In an example, the first mating surface 40 of the base ramp 22 on base member 18, and the second mating surface 42 on the mounting ramp 28 of the target mounting member 24 are helical in shape. Other shapes may also be implemented, as will be understood by those having ordinary skill in the art after becoming familiar with the teachings herein.

In an example, the first mating surface 40 of the base ramp 22, and the second mating surface 42 of the mounting ramp 28 are at least partly congruent with one another. That is, the shapes of the ramps are identical when superimposed over one another, but when one is turned upside down relative to the other, the two surfaces mate with one another. Rotation between the base member 18 and the target mounting member 24 causes the base member 18 and the target mounting member 24 to move away from each other.

In an example, when the target 12 is struck, the force of the projectile on the target 12 causes the target 12 to rotate (e.g., from one of the firing positions shown in FIG. 5) into a hit position. Rotating of the base member 18 and the target mounting member 24 on the corresponding ramps 22 and 28 causes the base member 18 and the target mounting member 24 to move away from each other. In an example, the target mounting member 24 moves axially away from the base member 18 as the target 12 moves into the range of hit positions (see, e.g., FIG. 5). That is, the target mounting member 24 "climbs" or rides up the base ramp 22. The target mounting member 24 tends back toward the base member 18, e.g., under the force of gravity and/or a reset mechanism such as a spring, causing the target 12 to automatically reset.

The target mounting member 24 moves axially back toward the base member 19, returning the target 12 to one of the firing positions. In an example, when the target 12 is struck, the target mounting member 24 moves vertically or axially upward from the base member 18, and then returns or resets by moving vertically or axially downward toward the base member 18.

Figure 10:
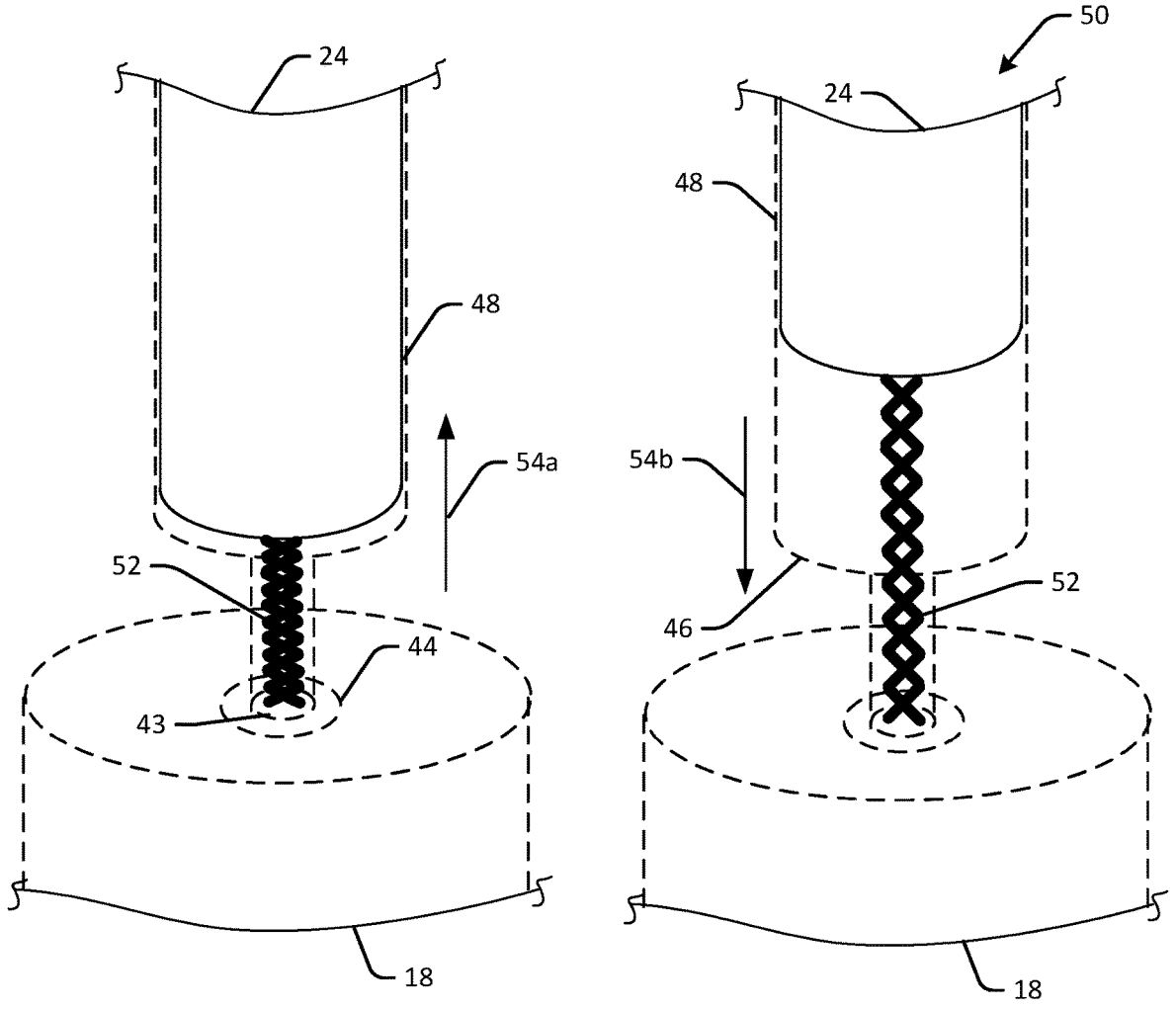
FIG. 10 illustrates an example reset mechanism of the axial reset target structure.

FIG. 10 illustrates an example reset mechanism 50 of the axial reset target structure 10. In FIG. 10, an internal portion of the base member 18 and an internal portion of the target mounting member 24 are illustrated, as these may be connected by a reset member 52 (e.g., a spring). It is noted that the reset member 52 is illustrated as an example of an automatic reset mechanism 50, but the axial reset target structure 10 is not limited to use with spring. Other examples are discussed herein and still other mechanisms will be readily apparent to those skilled in the art after becoming familiar with the teachings herein.

In an example, the reset member 52 may be attached to the bottom of cylinder or post member 48 of the target mounting member 24, and extends through receiving chamber 46 of the base member 18 and is attached thereto (e.g., by a plate 44 under the opening at the bottom of reset chamber 43 under the receiving chamber 46). It is noted that receiving chamber 46 may house other return mechanisms and reset member 52 is not limited to being a "spring". The reset member 52 (e.g., a spring mounted to both the target mounting member 24 and the base member 18), biases the target mounting member 24 and the base member 18 toward each other (e.g., in one of the firing positions shown in FIG. 5). When the target 12 is struck by a projectile and the target mounting member 24 moves axially away from the base member 18, the reset member 52 is stretched (in an example where the reset member 52 is a spring).

In an example, the reset member 52 applies a force on the target mounting member 24 and pulls the target mounting member 24 back toward the base member 18. This downward motion rotates the mounting ramp 28, and hence the target 12, in the second direction relative to the base ramp 22 to automatically reset the target 12 in the firing position.

It is noted that any suitable reset member 52 may be provided. For example, the reset member 52 may be at least one magnet, at least one compression spring, at least one tension spring, at least one of a piston, a piston spring, an air spring, an airbag, a vacuum chamber, and compressed gas. In an example, the reset member 52 is at least one of a compressible and resilient material (e.g., rubber) that tends or biases the target mounting member 24 toward the base member 18, while the ramps 22 and 28 rotate the target 12 back to the firing position, as illustrated by FIGS. 11 and 12.

Figure 11:
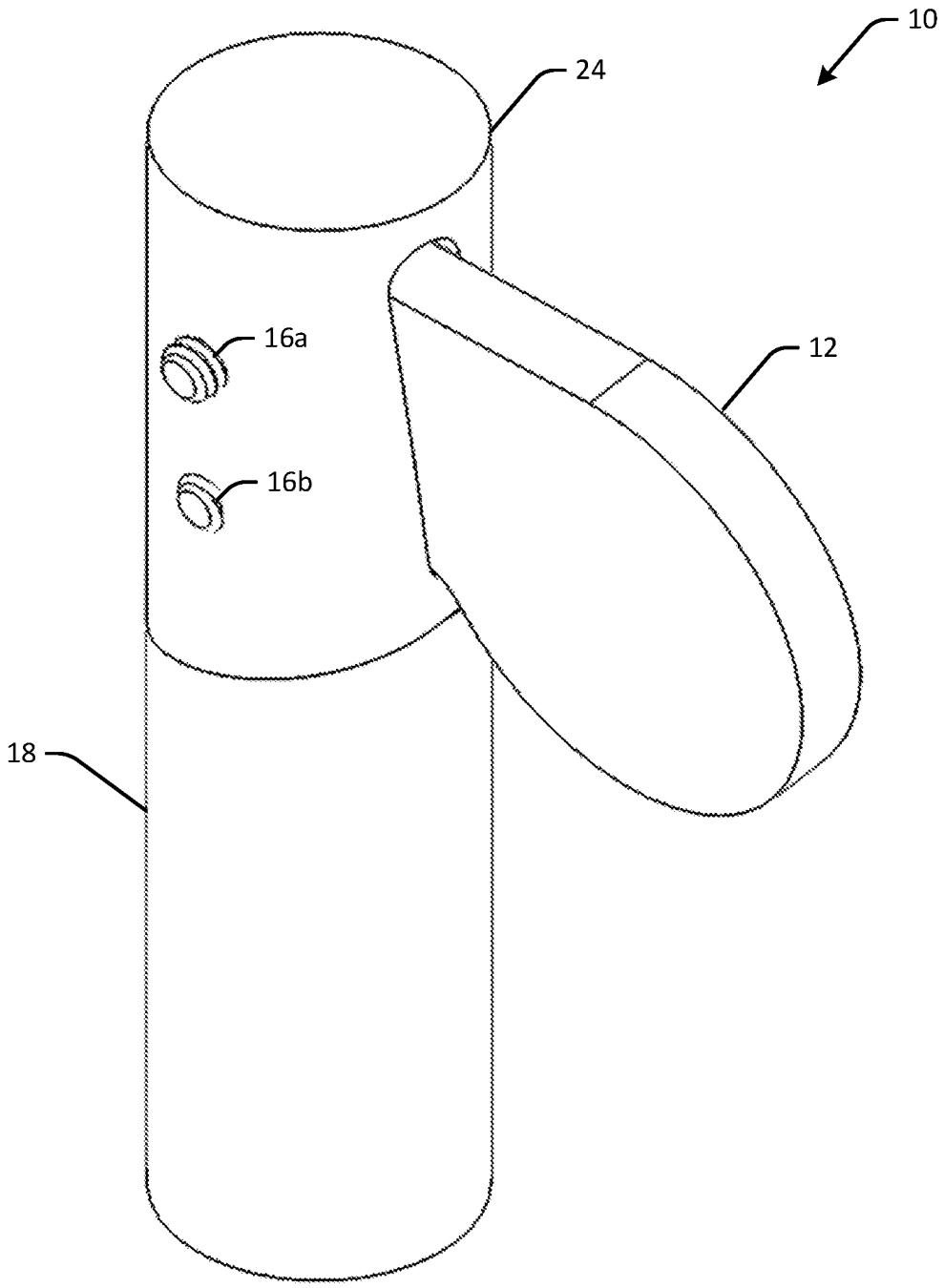
FIG. 11 is a perspective view of an example base member assembled to an example target mounting member of the axial reset target structure, shown in a firing position.
Figure 12:
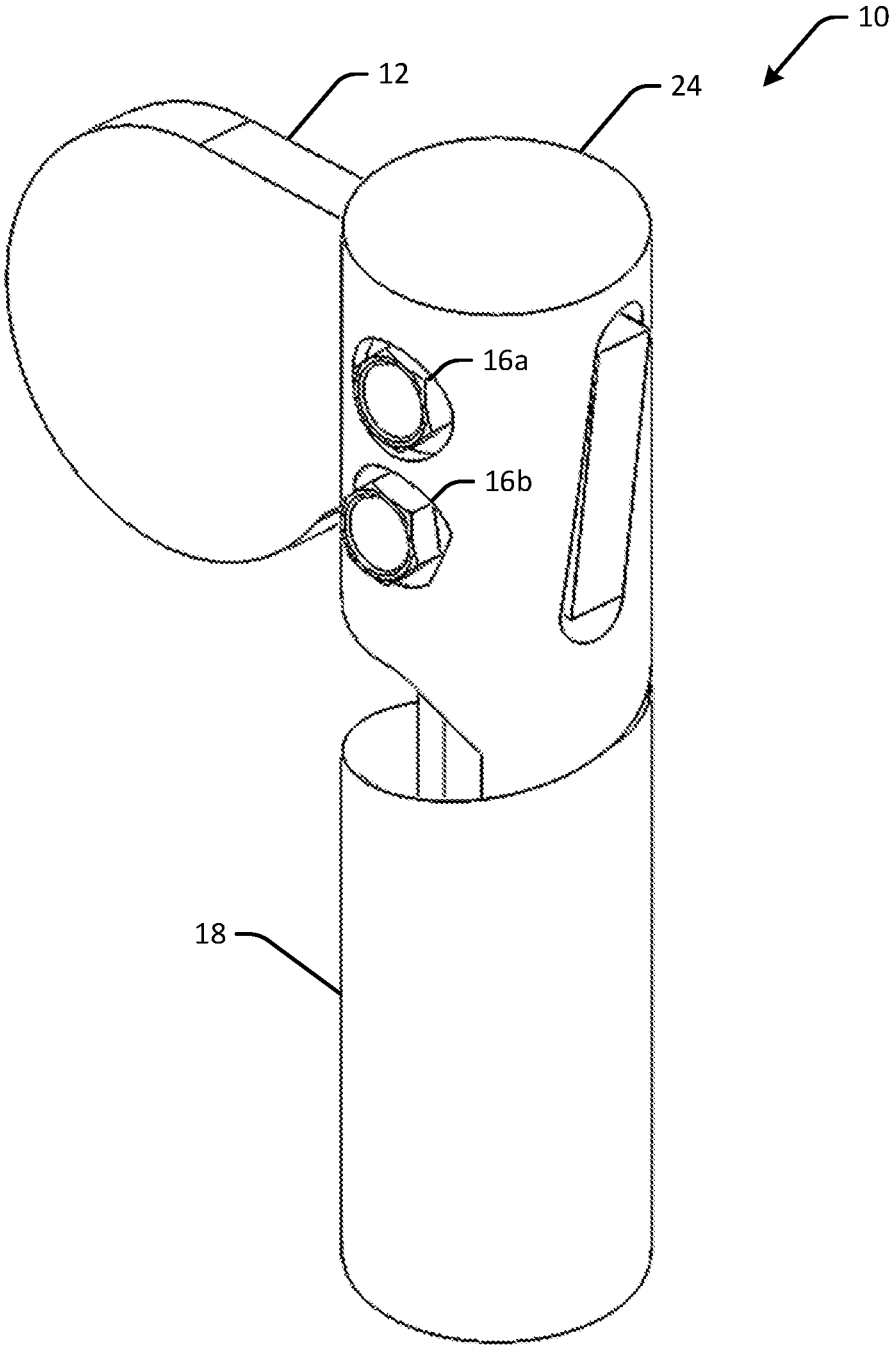
FIG. 12 is a perspective view of an example base member assembled to an example target mounting member of the axial reset target structure, shown in a hit position.

FIG. 11 is a perspective view of the example base member 18 assembled to the example target mounting member 24 of the axial reset target structure, shown in a firing position. FIG. 12 is a perspective view of the example base member 18 assembled to the example target mounting member 24 of the axial reset target structure 10, shown in a hit position.

The first mating surface 40 of the base ramp 22 mates with the second mating surface 42 of the mounting ramp 28 in a first firing position (see, e.g., firing position 30*a* in FIG. 5) for firing at the target 12 mounted to the target mounting member 24.

The mounting ramp 28 rotates in a first direction (e.g., illustrated by arrows 32*a*, 32*b* in FIG. 5) relative to the base ramp 22 to move the target mounting member 24 away from the base member 18 in the hit position (e.g., 30*c*, 30*d* illustrated in FIG. 5) when the target 12 is struck.

In an example, the mounting ramp 28 rotates in a second direction (e.g., illustrated by arrows 32*c* and 32*d*, or 32*e*) relative to the base ramp 22 to return the target mounting member 24 back to the first firing position thereby resetting the target 12 for firing.

In another example, the mounting ramp 28 rotates again in the first direction after being fired on (e.g., continuing in the direction illustrated by arrows 32*a*, 32*b*) to continue to move or rotate the target mounting member 24 into a second firing position (e.g., illustrated at 30*b* in FIG. 5) for firing at the target 12. The mounting ramp rotates back to a hit position when the target 12 is struck again in the second firing position. The mounting ramp rotates in a second direction relative to the base ramp to return the target mounting member back to the first firing position thereby resetting the target in the first firing position.

It is noted that, depending on the force of the projectile, the target 12 may rotate fully between firing positions 30*a* and 30*b*, keep returning to position 30*a*, keep returning to position 30*b*, and so forth. For example, moving between firing positions 30*a* and 30*b* may indicate a more direct hit (better shot), versus a glancing blow by the projectile on the target 12. Other factors that may affect rotation of the target 12 may include the type of projectile, distance to the target, etc.

Figure 13:
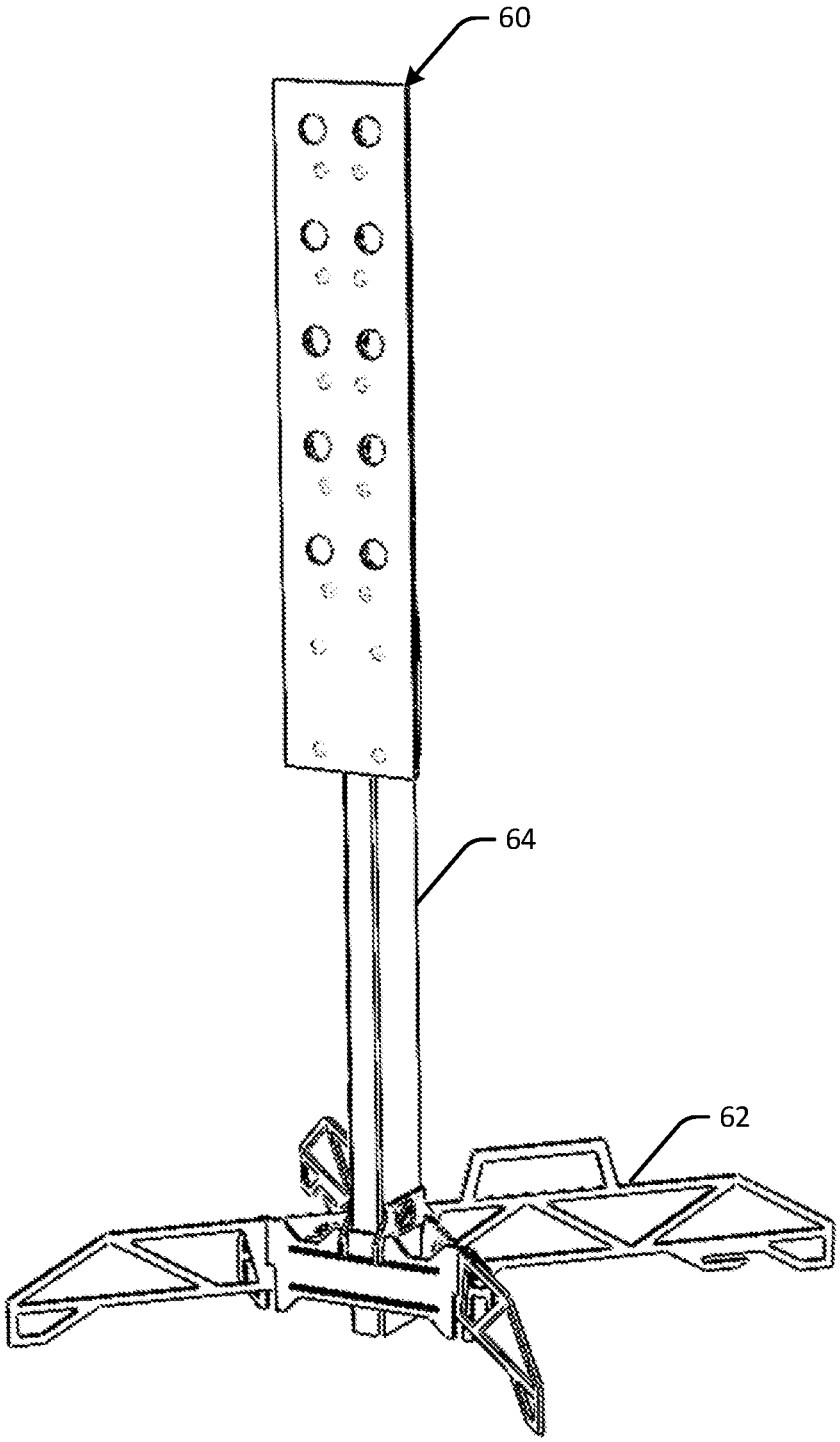
FIG. 13 is a front perspective view showing a plurality of axial reset target structures supporting a target.
Figure 14:
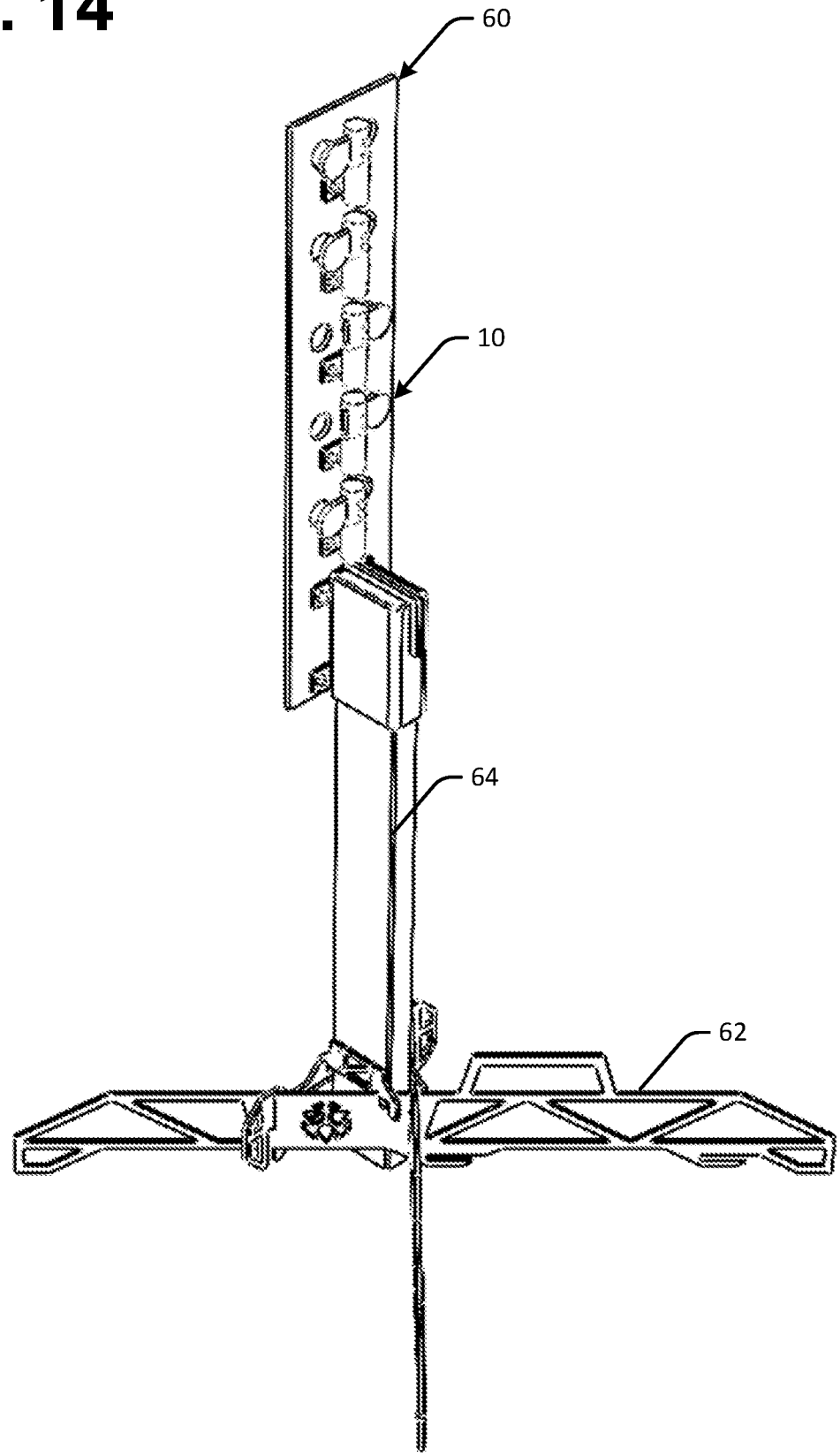
FIG. 14 is a rear perspective view showing a plurality of axial reset target structures supporting a target.

While the axial reset target structure 10 has been described herein with reference to a target 12 mounted to a single structure 10, it is noted that multiple axial reset target structures 10 may be implemented to support a larger target. FIG. 13 is a front perspective view showing a plurality of axial reset target structures 10 supporting a target 60 on a stand 64 on base 62. FIG. 14 is a rear perspective view showing the plurality of axial reset target structures 10 supporting the target 60 in FIG. 14. Still other implementations of the axial reset target structure 10 are contemplated as being within the scope of the appended claims, as will be readily understood by those having ordinary skill in the art after becoming familiar with the teachings herein. The scope of the claims is not intended to be limited to these examples.

It is noted that the examples shown and described are provided for purposes of illustration and are not intended to be limiting. Still other examples are also contemplated.

The invention claimed is:

1. An axial reset target structure for supporting targets during target practice, comprising:

a base member having an upper portion and a lower portion, a receiving chamber formed in the base member, and a reset chamber formed adjacent to the receiving chamber;

a base ramp in the upper portion of the base member, the base ramp having a first mating surface;

a target mounting member having an upper portion and a lower portion, and a post member forming the lower portion, the post member provided in the receiving chamber of the base member, wherein the target mounting member is configured for mounting a target thereto;

a mounting ramp in the lower portion of the target mounting member, the mounting ramp having a second mating surface;

at least one firing position for firing at the target mounted to the target mounting member, the first mating surface of the base ramp mating with the second mating surface of the mounting ramp in the at least one firing position;

a hit position when the target is struck, the mounting ramp rotating in a first direction relative to the base ramp to move the target mounting member away from the base member in the hit position; and a reset member in the reset chamber, wherein the reset member acts on the target mounting member to automatically reset the target to the at least one firing position.

2. The axial reset target structure of claim 1, wherein the mounting ramp rotates in a second direction relative to the base ramp to return the target mounting member back to the at least one firing position thereby resetting the target for firing.

3. The axial reset target structure of claim 2, wherein the first direction is opposite of the second direction.

4. The axial reset target structure of claim 1, wherein the first mating surface of the base ramp and the second mating surface of the mounting ramp each have a curved shape.

5. The axial reset target structure of claim 1, wherein the first mating surface of the base ramp and the second mating surface of the mounting ramp are congruent with one another.

6. The axial reset target structure of claim 1, wherein when the target is struck, the target mounting member moves axially away from the base member to the hit position.

7. The axial reset target structure of claim 1, wherein when the target is reset, the target mounting member moves axially back toward the base member to the at least one firing position.

8. The axial reset target structure of claim 1, wherein when the target is struck, the target mounting member moves vertically upward from the base member.

9. The axial reset target structure of claim 1, wherein the base member and the target mounting member are configured such that gravity rotates the mounting ramp in a second direction relative to the base ramp to automatically reset the target in the at least one firing position.

10. The axial reset target structure of claim 1, wherein the reset member applies a force on the target mounting member that rotates the mounting ramp in a second direction relative to the base ramp to automatically reset the target in the at least one firing position.

11. The axial reset target structure of claim 10, wherein the reset member is at least one magnet.

12. The axial reset target structure of claim 10, wherein the reset member is at least one compression spring.

13. The axial reset target structure of claim 10, wherein the reset member is at least one tension spring.

14. The axial reset target structure of claim 10, wherein the reset member is at least one of a piston, a piston spring, an air spring, an airbag, and compressed gas.

15. The axial reset target structure of claim 10, wherein the reset member is at least one of a compressible and resilient material.

16. An axial reset target structure for supporting targets during target practice, comprising:

a base member having an upper portion and a lower portion, a receiving chamber formed in the base member, and a reset chamber formed adjacent to the receiving chamber;

a base ramp in the upper portion of the base member, the base ramp having a first mating surface;

a target mounting member having an upper portion and a lower portion, and a post member forming the lower portion, the post member provided in the receiving chamber of the base member, wherein the target mounting member is configured for mounting a target thereto;

a mounting ramp in the lower portion of the target mounting member, the mounting ramp having a second mating surface;

a first firing position for firing at the target mounted to the target mounting member, the first mating surface of the base ramp mating with the second mating surface of the mounting ramp in the first firing position;

a hit position when the target is struck, the mounting ramp rotating in a first direction relative to the base ramp to move the target mounting member away from the base member in the hit position; and a reset member in the reset chamber, wherein the reset member acts on the target mounting member to automatically reset the target to the first firing position.

17. The axial reset target structure of claim 16, wherein the mounting ramp rotates in a second direction relative to the base ramp to return the target mounting member back to the first firing position thereby resetting the target for firing.

18. The axial reset target structure of claim 16, wherein the mounting ramp rotates again in the first direction to continue to move the target mounting member into a second firing position for firing at the target.

19. The axial reset target structure of claim 18, wherein when the target is struck in the second firing position, the mounting ramp rotates back to the hit position.

20. The axial reset target structure of claim 19, wherein the mounting ramp rotates in a second direction relative to the base ramp to return the target mounting member back to the first firing position thereby resetting the target in the first firing position.

* * * * *